United States Patent [19]

Hunter

[11] Patent Number: 5,017,128

[45] Date of Patent: May 21, 1991

[54] CHILD-RESISTANT DISPOSABLE LIGHTER WITH SPARK WHEEL ARRESTER

[76] Inventor: Robert M. Hunter, 320 S. Willson Ave., Bozeman, Mont. 59715

[21] Appl. No.: 421,786

[22] Filed: Oct. 16, 1989

Related U.S. Application Data

[63] Continuation-in-part of Ser. No. 300,752, Jan. 23, 1989, abandoned.

[51] Int. Cl.[5] ..... F23Q 25/00; F23D 11/36

[52] U.S. Cl. ..... 431/277; 431/153; 431/344; 222/153; 222/402.11

[58] Field of Search ..... 431/153, 277, 129, 142, 431/144, 344; 222/153, 402.11, 384

[56] References Cited

U.S. PATENT DOCUMENTS 3,744,953 7/1973 Herr ..... 431/129
4,717,335 1/1988 Loveless ..... 431/153 X
4,859,172 8/1989 Nitta ..... 431/153
4,869,662 9/1989 LeCourt et al. ..... 431/153

FOREIGN PATENT DOCUMENTS 0296281 12/1988 European Pat. Off. ..... 431/153

*Primary Examiner*—Carl D. Price

[57] ABSTRACT

A child-resistant disposable lighter relies for its effectiveness on differences in the ways young children and adults think rather than on presumed (but often non-existent) strength or dexterity differences. The child-resistant feature comprises a combination lock mechanism that incorporates at least one directly manipulated member, and, in some embodiments, at least one indirectly movable member. Some embodiments incorporate a feature that arrests rotation of the spark wheel when the thumb lever is locked in the child-resistant condition.

4 Claims, 2 Drawing Sheets

CHILD-RESISTANT DISPOSABLE LIGHTER WITH SPARK WHEEL ARRESTER

The present application is a continuation in part of copending application Ser. No. 300,752 filed Jan. 23, 1989, now abandoned and entitled *Child-Resistant Disposable Lighter.*

FIELD OF INVENTION

This invention relates to the field of child-resistant lighters and, more particularly, to the field of child-resistant disposable lighters of the flint and spark wheel variety.

BACKGROUND

Portable, hand-held lighters are used to ignite combustible materials, typically cigarettes and cigars. Such lighters comprise a fuel in a reservoir, a means of exposing the fuel to air and a means of igniting the fuel. One class of lighters, disposable lighters, require particular caution in their use. These lighters are typically constructed of injection molded thermoplastic and contain a fuel, such as butane, that is normally a gas at atmospheric pressure. In these lighters, the fuel is stored under pressure in a liquid state. Its unauthorized discharge into the air and ignition can cause an explosion. Because of potential hazards associated with unauthorized use of disposable lighters, it is likely that the United States Consumer Products Safety Commission will require that they be made child resistant.

Conventional, disposable lighter designs require two actions for their use. First, a valve on a discharge tube leading from the fuel reservoir to the discharge nozzle must be opened. Second, the gaseous fuel exposed to the oxygen in the air after it is released through the discharge nozzle must be ignited, typically by means of a spark. In conventional, disposable lighter designs, both of the actions required for use are accomplished by grasping the body of the lighter in the palm of the hand with the top of the lighter and the thumb oriented upward and by making a downward motion with the tip of the thumb. The downward motion of the tip of the thumb accomplishes opening of the valve on the discharge tube and ignition of the gaseous fuel.

In conventional flint and spark wheel type lighters, the downward motion of the tip of the thumb pushes down one end of a small lever. The other end of the lever is thereby caused to rise, pulling upward on the valve on discharge tube and opening it. The same downward motion of the tip of the thumb rotates a spark wheel. Rotation of the spark wheel causes its circumference to rub against a sparking medium, such as flint, which emits sparks in the direction of the discharging gas stream.

Both the discharge of the gaseous fuel and the emission of sparks can create hazards, alone and in concert. Mixture of the gaseous fuel with air creates a flammable mixture. Emission of the sparks can ignite this flammable mixture or other flammable substances in the vicinity of the lighter. Both occurrences must, therefore, be controlled to ensure the safety of the lighters in the hands of children.

A child-resistant disposable lighter is essentially a locked package having a "key" that adults possess and children do not. Most child-resistant packaging (CRP) on the market today relies on "locks" that have both cognitive skill and strength or dexterity based "keys."

This type of CRP is generally inaccessible by older adults. Other types of CRP utilize actual keys, but are less practical.

CRP with locking mechanisms that do not rely on actual keys or on presumed strength or dexterity differences between children and adults are also possible. These types of CRP are cognitive skill based, that is, they rely on cognitive skills that adults possess and children under the age of five do not, e.g., problem-solving skills.

A variety of cognitive skill based child-resistant disposable flint and spark wheel lighter designs have been proposed. In general, these designs use locking mechanisms either to prevent children from opening of the valve on the discharge tube leading from the fuel reservoir or to prevent children from generating a spark. Examples of the first type of design include those disclosed in U.S. Pat. Nos. 4,830,603 (Cirami) and 4,832,596 (Morris). Examples of the second type include those disclosed in U.S. Pat. Nos. 4,717,335 (Loveless) and 4,822,276 (Bisbee). To date, a child-resistant disposable lighter design that prevents both operations necessary for lighter ignition has not been disclosed.

Furthermore, no child-resistant disposable lighters disclosed to date utilize a member rotatable about an axis parallel to that of the lighter body to provide child resistance in a way that does not deny access to the lighter thumb lever. In U.S. Pat. No. 4,758,152 (Kordecki), a lighter is disclosed that incorporates a pivoting bar to deny access to the lever.

NATURE OF THE INVENTION

The present invention provides a disposable lighter that is relatively easy for older people or people with physical disability to use but that is inexpensive and child resistant.

The preferred embodiments of the invention involve improving conventional disposable lighters by adding cognitive skill based child-resistant features. These features comprise a combination lock mechanism using either one or more directly manipulated members or one or more indirectly manipulated members. In this case, the member(s) are circular in nature and moved to an unlocked position using rotation(s) in one plane of rotation.

A variety of embodiments of this invention are disclosed herein. In general, the embodiments can be classified as follows in terms of the number of movable parts that function in a manner analogous to tumblers in a combination lock and by the type of movement used to move the parts to the locked and unlocked positions:

1. Locking mechanism has a single, directly driven, movable part wherein the kind movement is rotation in a plane around an axis parallel to that of the lighter body.
2. Locking mechanism has a plurality of movable part wherein the movement being rotation in a plane around an axis parallel to that of the lighter body.
   a. At least one part is indirectly driven
   b. All parts are directly moved For the purposes of this disclosure, the axis of the lighter body is defined as the vertical axis through the center of the lighter body when the lighter is held upright. In all instances, linear movement of the rotatable part (along its axis of rotation) between rotations is not required. Thus, all of the embodiments disclosed herein call for the movable part(s) to be moved in one kind of motion (i.e., rotation in one plane).

In the preferred embodiment, the locking mechanism has a plurality of movable parts, at least one of which is indirectly rotated around an axis parallel to that of the lighter body to unlock the lighter. In this embodiment, a linear member is movably attached to the end of the lever that is depressed to open the fuel discharge valve. A pinned connection between the linear member and the lever is shown, but any connection that allows operation of the lever and upward and downward movement of the linear member is acceptable. Alternatively, the linear member may be integrally molded on one end of the lever, and, as such, may be an integral part of the lever. The linear member extends axially downward into the body of the lighter. It is provided with at least two horizontally oriented notches. The body of the lighter is provided with rotatable parts, each of which is oriented with its axis parallel to the axis of the lighter body and at least a portion of each of which is configured to fit into a different one of the notches in the linear member, and one of which is accessible to manual rotation. When the lighter is in the locked (i.e., off) position, a portion of each of the rotatable parts fits a different one of the notches in the linear member. Each of the rotatable parts is also provided with a notch, the width of which is at least as wide as the width of the portion of the linear member in the vicinity of its notches. Means of interaction between the rotatable parts is provided so that manual rotation of one part can be used to rotate the other part. At least the rotatable part that is not accessible to manual rotation is frictionally engaged with either the body of the lighter or the linear member so that it normally does not move unless driven by movement of the other rotatable part. When the rotatable parts are moved to certain positions of rotation, the notches in the rotatable parts are aligned with each other and with the linear member. When this is the case, the linear member is capable of upward and downward movement and the lighter is unlocked.

A lighter having a lighter body, a portion of which contains a compressed, flammable fluid, a valve on an opening in said body portion that allows the fluid to discharge from said body portion, a means for opening and closing said valve (e.g., a thumb lever), and a means for igniting said discharged fluid (e.g., a spark wheel), both of said means requiring at least one motion to operate (e.g., a downward movement of the thumb) is improved to provide child resistance. The improvement comprises at least one first rotatable part (e.g., a wheel) for blocking the motion of at least said means for opening and closing said valve, said blocking action occurring only when said first rotatable part is in at least one position, the locked position. The rotatable part may block (indirectly or otherwise) the movement of other elements, such as the spark wheel. The rotatable wheel is capable of being moved to a plurality of positions by rotation. At least one of these positions causes the blocking action. The first rotatable part is movably attached to said lighter body and the movement of the rotatable part occurs only in a single plane of rotation about an axis parallel to the axis of said lighter body. The axis of rotation may or may not be coincident with the longitudinal axis of a linear element extending downward into the lighter body. Blocking of the motion of the thumb lever occurs while both the means for opening and closing said valve and the spark wheel are accessible to attempts at manual manipulation. This strategy allows a child operator to incorrectly conclude that normal lighter operation is possible. Research by the inventor has shown that child resistance of packaging is increased by providing many incorrect "solutions" to the problem of package unlocking and only one correct solution.

Incorporation of a child-resistant feature into disposable lighters would increase the safety of such devices. Disposable lighters on the market today typically rely on a linear, axial, downward motion to both turn on the butane gas supply and ignite the gas. In the flint and spark wheel lighter types, a downward motion of the thumb simultaneously depresses a lever that turns on the butane supply and spins the spark wheel which ignites the gas.

One technique by which child resistance could be incorporated into disposable lighters would be to add an element to the devices that would prevent or block the above described downward motion from being accomplished by children. Of course, the design of the element would have to be such that adults could easily manipulate it to allow operation of the lighter.

It is an object of this invention to improve conventional disposable lighter designs by providing child resistance. It is a further object of this invention to disclose a child-resistant disposable lighter technology having child-resistance that is cognitive skill based. Cognitive skill based child-resistance relies on differences in the ways that children and adults think rather than on presumed differences in strength or manual dexterity between children and adults.

It is an objective of this invention to use at least one rotatable element having an axis of rotation parallel to that of the lighter body to provide cognitive skill based child resistance. Rotatable elements require little space within the lighter body to provide a high probability that they will not be positioned in an unlocked condition which is the reason the same configuration is used on conventional combination locks. Furthermore, having an axis of rotation parallel to that of the lighter body allows the lighter to be held in one hand and the rotatable elements to be easily rotated with a thumb on the same hand.

It is another object of this invention to incorporate a feature that arrests the spark wheel of a lighter when the lighter is locked in a child-resistant condition. It is also an object not to deny access to the lever or spark wheel when the lighter is in the child-resistant condition, thus, giving children the impression that the lighter is operable when, in fact, it is not.

Additional objects and features of the invention will appear from the following description in which the preferred embodiments have been set forth in detail in conjunction with the accompanying drawings.

BRIEF DESCRIPTION OF THE DRAWINGS

These features will be better understood by reference to the accompanying drawings which illustrate presently preferred embodiments of the invention.

In the drawings.

DETAILED DESCRIPTION

Figure 1:
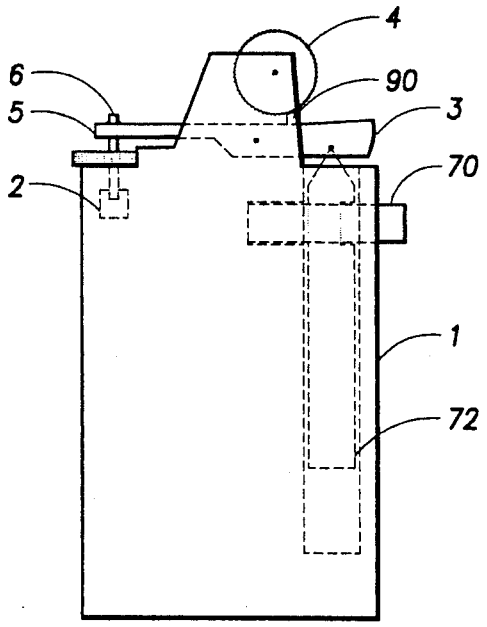
FIG. 1 is a side elevation view of a flint and spark wheel lighter having a locking mechanism comprised of at least one rotatable wheel.
Figure 2:
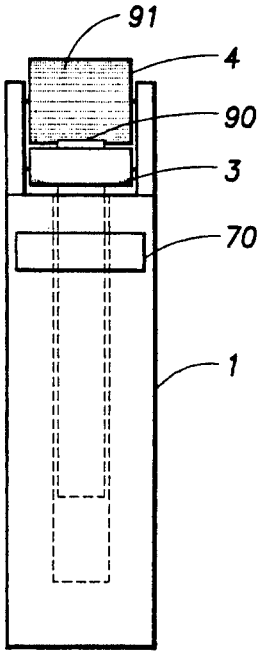
FIG. 2 is another side elevation view of the same flint and spark wheel lighter shown in FIG. 1.

An embodiment of the invention wherein the locking mechanism comprises at least one rotatable wheel is presented in FIGS. 1 and 2. In this embodiment the axis of rotation of the rotatable wheel 70 is coincident with the axis of linear element 72. The at least one rotatable wheel 70 has a hole at its center that is circular except for a notch in the circumference of the otherwise circular hole. In one position of rotation, rotatable wheel 70 is capable of accommodating all cross sections of linear element 72. In all other positions, the hole in rotatable wheel 70 is capable of accommodating only the portion of linear element 72 that is presented to it when linear element 72 is in the upward, locked position. In an alternative embodiment, a plurality of similar wheels are rotatably attached to body 1 and are capable of interacting with other portions of linear element 72 in a similar manner.

Figure 3:
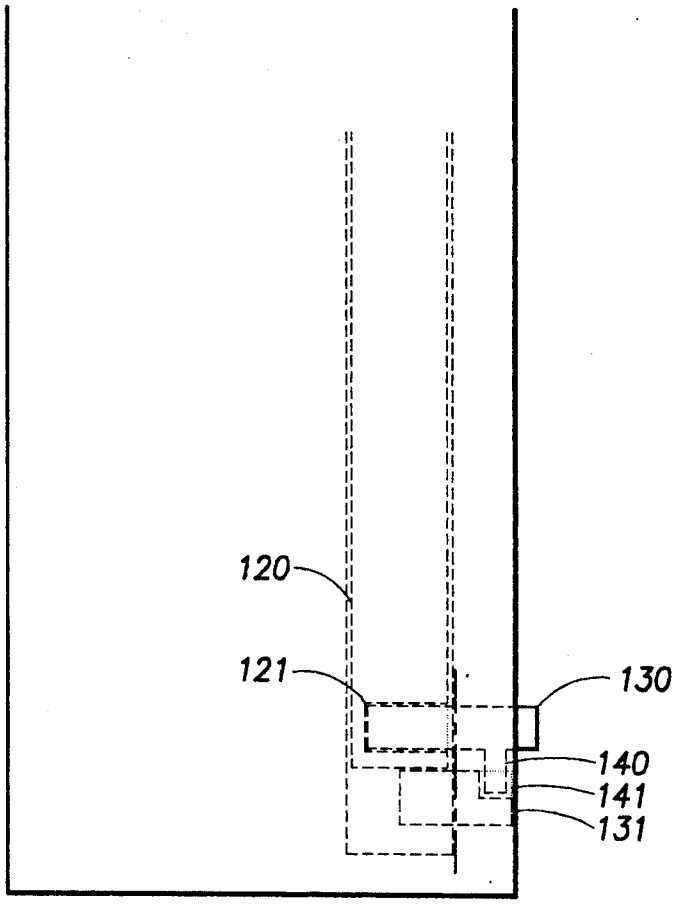
FIG. 3 is a partial side elevation view of a child-resistant lighter having a locking mechanism comprised of two, interacting rotatable parts.
Figure 4:
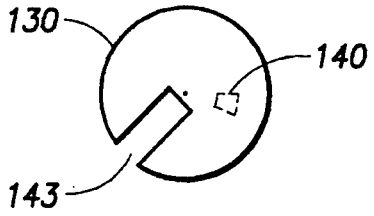
FIG. 4 presents an enlarged plan view of rotatable wheel 130.
Figure 5:
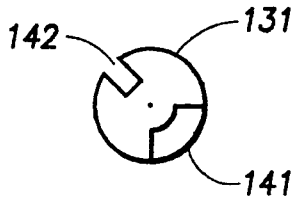
FIG. 5 presents an enlarged plan view of rotatable wheel 131.

In the preferred embodiment, shown in FIG. 3, the locking mechanism comprises two rotatable wheels, only one of which is accessible to direct manual manipulation. In this embodiment the axis of rotation of the rotatable wheels is not coincident with the axis of linear element 120. As illustrated in the enlarged view shown in FIG. 3, linear element 120 may have only one notch 121 and the user may have access to only one of two rotatable wheels 130 and 131. As indicated in FIGS. 4 and 5, one of the rotatable wheels, in this embodiment rotatable wheel 130 to which the user has access, is provided with a driving lug 140. This driving lug 140 extends downward into circumferential notch 141. The circumferential notch 141 is longer in the circumferential direction than driving lug 140 is wide in that direction as shown in FIG. 4. Thus, rotatable wheel 130 may be rotated a significant degree before driving lug 140 hits the wall of notch 141 and causes rotatable wheel 131 to rotate.

To unlock the embodiment shown in FIG. 3, rotatable wheel 130 is first rotated in one direction to drive rotatable wheel 131 to the position at which the notch 142 is aligned with linear element 120. Then rotatable wheel 130 is rotated in the opposite direction until the notch 14 is aligned with linear element 120. During the second rotation, rotatable wheel 131 is held in position by friction with lighter body 120.

Also shown in FIGS. 1 and 2 is tooth 90 which engages with teeth 91 on spark wheel 4 to prevent rotation of spark wheel 4 when the lighter is in the locked position. Movement of lever 3 downward disengages tooth 90 from teeth 91. Of course, this modification is applicable to lighters incorporating other means of blocking the motion of the lever. Alternative means of preventing the motion of the spark wheel, such as friction pads, could be used instead of a tooth.

Many variations in configuration have been discussed and other embodiments will be obvious to those skilled in the art. For example, the linear element could be attached to the end of the lever that travels upward to open the valve. In this instance, the movable locking elements would be configured to prevent upward motion of the linear element.

Some variations within the scope of the claims include lighters that are not disposable. Furthermore, all of the embodiments of the invention illustrated and described previously with respect to flint and spark wheel lighter types may also be implemented on electric ignition lighter types. All such variations within the scope of the claims are intended to be within the scope and spirit of the present invention.

The invention is not to be construed as limited to the particular forms disclosed herein, since these are to be regarded as illustrative rather than restrictive. It is the intention of this patent to cover all changes and modifications of the example of the invention herein chosen for the purposes of the disclosure, which do not constitute departures from the spirit and scope of the invention.

I claim:

1. A lighter improved to provide child resistance having a lighter body, a portion of which contains a compressed, flammable fluid, a valve on an opening in said body portion that allows the fluid to discharge from said body portion, a means for opening and closing said valve, and a means for igniting said discharged fluid, both of said means requiring at least one motion to operate, the improvement comprising at least one first rotatable part for blocking the motion of said means for opening and closing said valve, said blocking action occurring only when said first rotatable part is in at least one position, wherein said first rotatable part is movably attached to said lighter body and the movement of said rotatable part occurs only in a single plane of rotation about an axis parallel to the axis of said lighter body, and wherein said blocking of the motion of at least said means for opening and closing said valve occurs while both the means for opening and closing said valve and the means for igniting said discharged fluid are accessible to attempts at manual manipulation, at least one means for preventing the motion of said means for igniting said discharged fluid, said preventing action occurring only when said means for preventing is in at least one position, said means for preventing being attached to said means for opening and closing said valve.

2. A lighter improved to provide child resistance having a lighter body, a portion of which contains a compressed, flammable fluid, a valve on an opening in said body portion, a means for opening and closing said valve, and a means for igniting said discharged fluid, both of said means requiring at least one motion to operate, the improvement comprising a first rotatable part for blocking the motion of at least said means for opening and closing said valve, said blocking action occurring only when said first rotatable part is in at least one position, wherein said first rotatable part is movably attached to said lighter body and the movement of said rotatable part occurs only in a single plane of rotation about an axis parallel to the axis of said lighter body, and wherein said blocking of the motion of at least said means for opening and closing said valve occurs while both the means for opening and closing said valve and the means for igniting said discharged fluid are accessible to attempts at manual manipulation, and a second rotatable part for blocking the motion of at least said means for opening and closing said valve, said blocking action occurring only when said second rotatable part is in at least one position, wherein said second rotatable part is movably attached to and supported by said lighter body, means for said first rotatable part to interact with and rotate said second rotatable part, said means being attached to at least one of said rotatable parts, wherein said second rotatable part is inaccessible to manual manipulation by a lighter user and is moved indirectly by movement of said first rotatable part.

3. The lighter of claim 2 wherein the means for said first rotatable part to interact with and rotate said second rotatable part is a lug.

4. The lighter of claim 1 wherein said means for preventing the motion of said means for igniting said discharged fluid is at least one tooth.

* * * * *